US010147509B2

(12) United States Patent
Singh

(10) Patent No.: US 10,147,509 B2
(45) Date of Patent: Dec. 4, 2018

(54) VENTILATED SYSTEM FOR STORING HIGH LEVEL RADIOACTIVE WASTE

(75) Inventor: Krishna P. Singh, Hobe Sound, FL (US)

(73) Assignee: HOLTEC INTERNATIONAL, INC.

( * ) Notice: Subject to any disclaimer, the term of this patent is extended or adjusted under 35 U.S.C. 154(b) by 1127 days.

(21) Appl. No.: 14/344,013

(22) PCT Filed: Sep. 10, 2012

(86) PCT No.: PCT/US2012/054529
§ 371 (c)(1),
(2), (4) Date: Mar. 10, 2014

(87) PCT Pub. No.: WO2013/036970
PCT Pub. Date: Mar. 14, 2013

(65) Prior Publication Data

US 2014/0226777 A1 Aug. 14, 2014

Related U.S. Application Data

(60) Provisional application No. 61/532,397, filed on Sep. 8, 2011.

(51) Int. Cl.

| | |
|---|---|
| ***G21F 5/10*** | (2006.01) |
| ***G21F 7/015*** | (2006.01) |
| ***G21F 9/24*** | (2006.01) |
| ***G21F 9/34*** | (2006.01) |

(52) U.S. Cl.
CPC ..... *G21F 5/10* (2013.01); *G21F 7/015* (2013.01); *G21F 9/24* (2013.01); *G21F 9/34* (2013.01)

(58) Field of Classification Search
CPC ... G21F 5/10; G21F 7/015; G21F 9/24; G21F 9/34
USPC ..... 376/272
See application file for complete search history.

(56) References Cited

U.S. PATENT DOCUMENTS

| | | | | |
|---|---|---|---|---|
| 3,236,053 A | | 2/1966 | Billue | |
| 3,910,006 A | | 10/1975 | James | |
| 5,789,648 A | * | 8/1998 | Roy | G21F 9/34 250/506.1 |

(Continued)

FOREIGN PATENT DOCUMENTS

WO 2006086766 8/2006

OTHER PUBLICATIONS

Corresponding Supplementary European Search Report for EP12829768 dated Apr. 28, 2015.
Corresponding International Search Report dated Nov. 26, 2012.

*Primary Examiner* — Jack W Keith
*Assistant Examiner* — John T Nolan
(74) *Attorney, Agent, or Firm* — The Belles Group, P.C.

(57) ABSTRACT

A ventilated system for storing high level radioactive waste, such as used nuclear fuel, in a below-grade environment, in one embodiment, the invention is a ventilated system comprising an air-intake shell and a plurality of storage shells that are interconnected by a network of pipes configured to achieve double redundancy and/or improved air delivery. In another embodiment, the invention is a ventilated system that utilizes a mass of low level radioactive waste contained in a hermetically sealed enclosure cavity, the low level radioactive waste providing radiation shielding for high level radioactive waste stored in a storage cavity of said ventilated system.

20 Claims, 11 Drawing Sheets

(56) References Cited

U.S. PATENT DOCUMENTS

| | | | | |
|---|---|---|---|---|
| 7,676,016 | B2 | 3/2010 | Singh | |
| 2002/0003851 | A1* | 1/2002 | Pennington | G21F 5/10 376/272 |
| 2006/0251201 | A1* | 11/2006 | Singh | G21F 5/10 376/272 |
| 2009/0159550 | A1* | 6/2009 | Singh | B66C 19/00 212/324 |

* cited by examiner

VENTILATED SYSTEM FOR STORING HIGH LEVEL RADIOACTIVE WASTE

CROSS-REFERENCE TO RELATED PATENT APPLICATIONS

This application is a U.S. national stage application under 35 U.S.C. § 371 of PCT Application No. PCT/US2012/054529, filed on Sep. 10, 2012, which claims the benefit of U.S. Provisional Patent Application No. 61/532,397, filed Sep. 8, 2011, the entireties of which are incorporated herein by reference.

FIELD OF THE INVENTION

The present invention relates generally to a ventilated system for storing high level radioactive waste, and specifically to a ventilated system for storing canisterized high level radioactive waste that is exceedingly safe against threats from human acts as well as those from extreme natural phenomena.

BACKGROUND OF THE INVENTION

The vast majority of used nuclear fuel produced by U.S. reactors since the dawn of commercial nuclear energy five decades ago is presently stored in fuel pools. In the past fifteen years, utilities have been moving used nuclear fuel to the so-called "dry storage" systems which are so named because the used nuclear fuel is stored in an extremely dry state surrounded by an gas, such as helium, to prevent degenerative oxidation. Dry storage of used nuclear fuel in casks acquitted itself extremely well during the Fukushima Daiichi cataclysm when the double-event of a Richter scale 9.0 earthquake followed by a 13.1+ meter high tsunami failed to cause a single cask at the site to leak. The fuel pools, on the other hand, suffered loss of cooling and structural damage. The Fukushima experience has undoubtedly given solid credentials to dry storage as a reliably safe means to store used nuclear fuel. Even before Fukushima, the security concerns in the wake of 9/11 had given a strong impetus in the United States to reduce the quantity of used nuclear fuel stored in the water-filled pools by moving it into dry storage. At present, a large number of canisters containing tons of used nuclear fuel are stored on-site at commercial storage facilities in the United States. Over 200 canisters are being added to the dry storage stockpile in the United States each year. On-site storage is also gaining wider acceptance in Europe and Japan.

At present, virtually every nuclear plant site has its own on-site storage facility, commonly referred to as an Independent Spent Fuel Storage Installation ("ISFSI"). ISFSI loaded with free-standing above-grade casks is an unmistakable presence in the plant's landscape that raises "optical" problems of community acceptance even though the dry storage casks are among the most tenor-resistant structures at any industrial plant. Even so, the perceived risk of a 9/11 type assault adds to the sense of unease that has been scarcely ameliorated by a not well publicized scientific finding by the experts at a U.S. national laboratory which holds that the casks in use at the U.S. plants are capable of withstanding the impact from a crashing aircraft without allowing any radioactive Matter to be released into the environment. The superb structural characteristics of the dry storage systems have likely played a role in the Presidential Blue Ribbon Commission's recent report that calls for Interim Storage of spent fuel in dry storage casks at a limited number of sites where the used nuclear fuel can be safely stored with utmost security and safeguarding of public health and safety. The term Independent Storage Facility ("ISF") is used to describe a safe and secure system for medium term use, such as a 300-year service life, that would avert the need for establishing a disposal site in the near future and preserve the prospect of future scientific developments to provide a productive use for the used fuel. Equally important, it is necessary to have a dry storage system that, by virtue of its inherent safety, wins the confidence and acceptance of the public.

SUMMARY OF THE INVENTION

In one embodiment the invention can be a ventilated system for storing high level radioactive waste: a below-grade storage assembly comprising: an air-intake shell forming an air-intake downcomer cavity and extending along an axis; a plurality of storage shells, each storage shell forming a storage cavity and extending along an axis; and for each storage shell, a primary air-delivery pipe that forms a primary air-delivery passageway from a bottom of the air-intake downcomer cavity to a bottom of the storage cavity, wherein the entirety of each of the primary air-delivery passageways is distinct from the entireties of all other of the primary air-delivery passageways of the below-grade storage assembly; a hermetically sealed container for holding high level radioactive waste positioned in one OF More of the storage cavities; and a lid positioned atop each of the storage shells and comprising at least one air-outlet passageway.

In another embodiment, the invention can be a ventilated system for storing high level radioactive waste: a below-grade storage assembly comprising: an air-intake, shell forming an air-intake downcomer cavity and extending along an axis; a plurality of storage shells, each storage shell forming a storage cavity and extending along an axis; and a network of pipes forming hermetically sealed passageways between a bottom portion of the air-intake cavity and a bottom portion of each of the storage cavities; a hermetically sealed container for holding high level radioactive waste positioned in one or more of the storage cavities; a lid positioned atop each of the storage shells and comprising at least one air-outlet passageway; and wherein for each storage cavity, the network of pipes defines at least three air-delivery passageways leading from the air-intake cavity to the storage cavity, wherein the entirety of each of the three air-delivery passageways is distinct from the entireties of the other two air-delivery passageways.

In yet another embodiment, the invention can be a ventilated system for storing high level radioactive waste: a below-grade storage assembly comprising: an air-intake shell forming an air-intake downcomer cavity and extending along an axis; a plurality of storage shells, each storage shell forming a storage cavity and extending along an axis; and a network of pipes forming hermetically sealed passageways between a bottom portion of the air-intake cavity and a bottom portion of each of the storage cavities; an enclosure forming an enclosure cavity, the below-grade storage assembly positioned with in the enclosure cavity, the enclosure we cavity being hermetically sealed; openings in the enclosure that provide access to each of the air-intake cavity and the storage cavities; a hermetically sealed container for holding high level radioactive waste positioned in one or more of the storage cavities; a lid positioned atop each of the storage shells; and for each storage cavity, at least one air-outlet passageway for allowing heated air to exit the storage cavity.

In still another embodiment, the invention can be a ventilated system for storing high level radioactive waste: at least one storage shell forming is storage cavity; at least one air-delivery passageway for introducing cool air to a bottom of the storage cavity; at least one air-outlet passageway for allowing heated air to exit the storage cavity: at least one hermetically sealed container for holding high level radioactive waste positioned in the storage cavity; an enclosure forming an enclosure cavity, the at least one storage shell positioned within the enclosure cavity, the enclosure cavity being hermetically sealed; an opening in the enclosure that provides access to the storage cavity; a lid enclosing a top end of the storage cavity; and a low level radioactive waste filling a remaining volume of the enclosure cavity that provides radiation shielding for the high level radioactive waste within the hermetically sealed containers.

In a further embodiment, the invention can be a ventilated system for storing high level radioactive waste: a radiation shielding body forming a storage cavity having an open-top end and a closed-bottom end, the radiation shielding body comprising a mass of low level radioactive waste; at least one air-delivery passageway for introducing cool air to a bottom of the storage cavity; at least one air-outlet passageway for allowing heated air to exit the storage cavity; at least one hermetically sealed container for holding high level radioactive waste positioned in the storage cavity; and a lid enclosing the open-top end of the storage cavity.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE DRAWINGS

Figure 1:
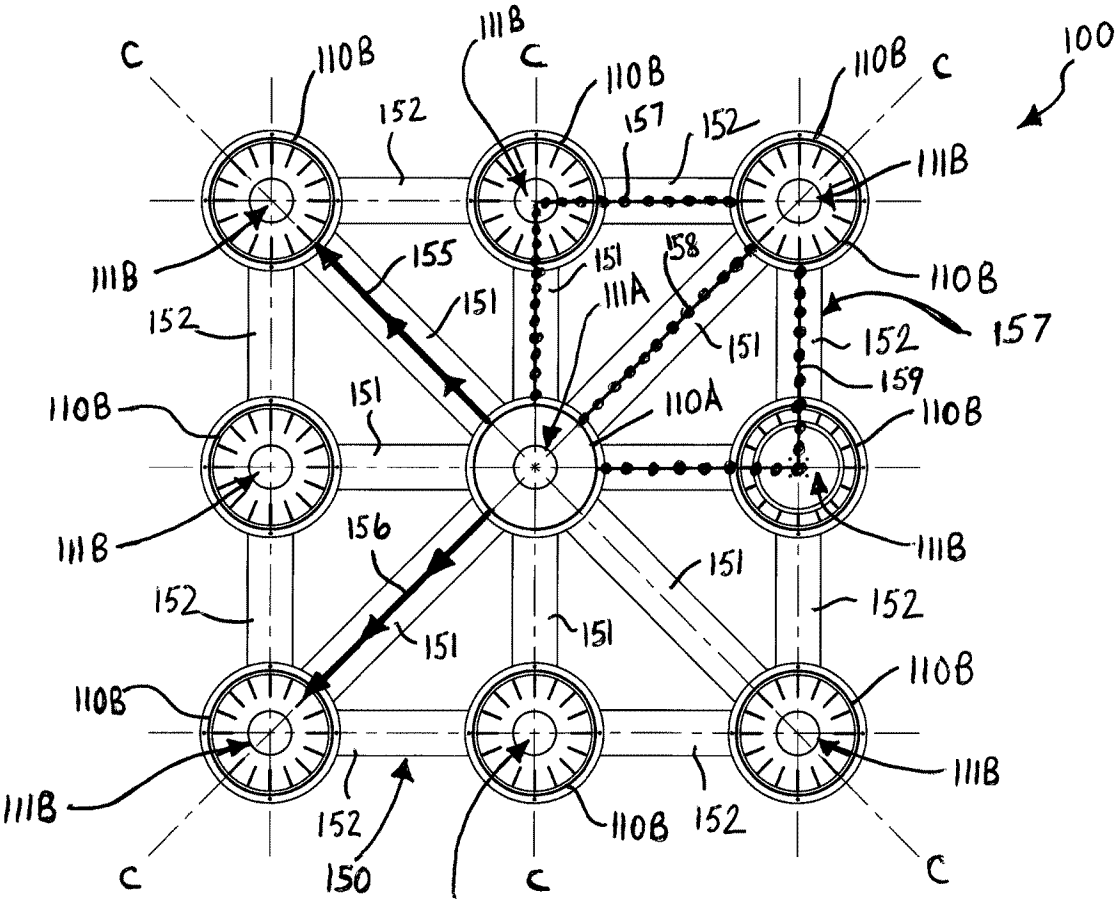
FIG. 1 is a top view of a storage assembly 100 according to an embodiment of the present invention.

The description of illustrative embodiments according to principles of the present invention is intended to be read in connection with the accompanying, drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.,) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

By way of background, the present invention, in certain embodiments, is an improvement of the systems and methods disclosed in U.S. Pat. No. 7,676,016, issued on Mar. 9, 2012 to Singh. Thus, the entirety of the structural details and functioning of the system, as disclosed in U.S. Pat. No. 7,676,016, is incorporated herein by reference. It is to be understood that structural aspects of the system disclosed in U.S. Pat. No. 7,676,016 can be incorporated into certain embodiments of the present invention.

Figure 2:
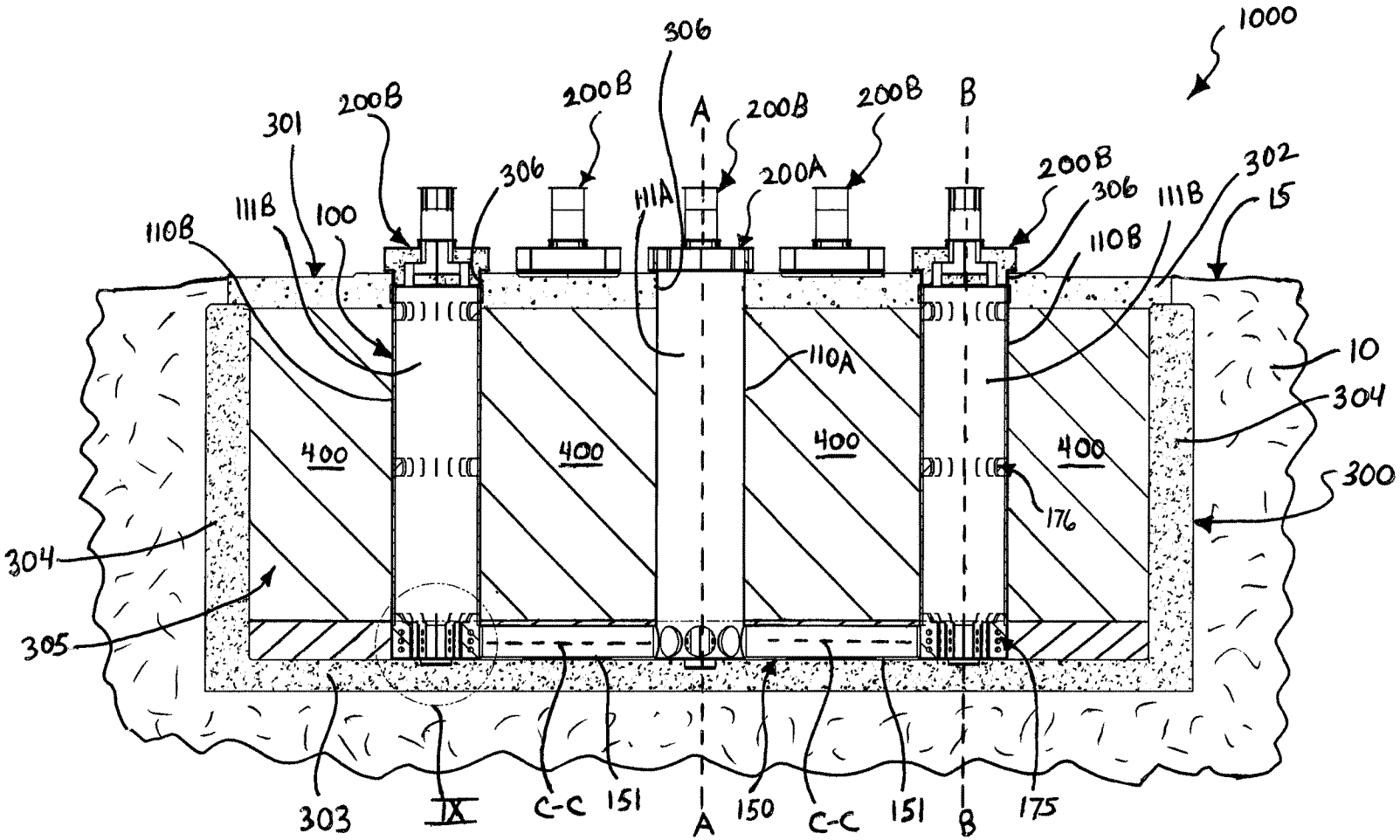
FIG. 2 is a cross-section taken along view II-II of FIG. 4 of a ventilated system for storing high level radioactive waste according to an embodiment of the present invention, wherein the ventilated system is positioned below-grade.
Figure 3:
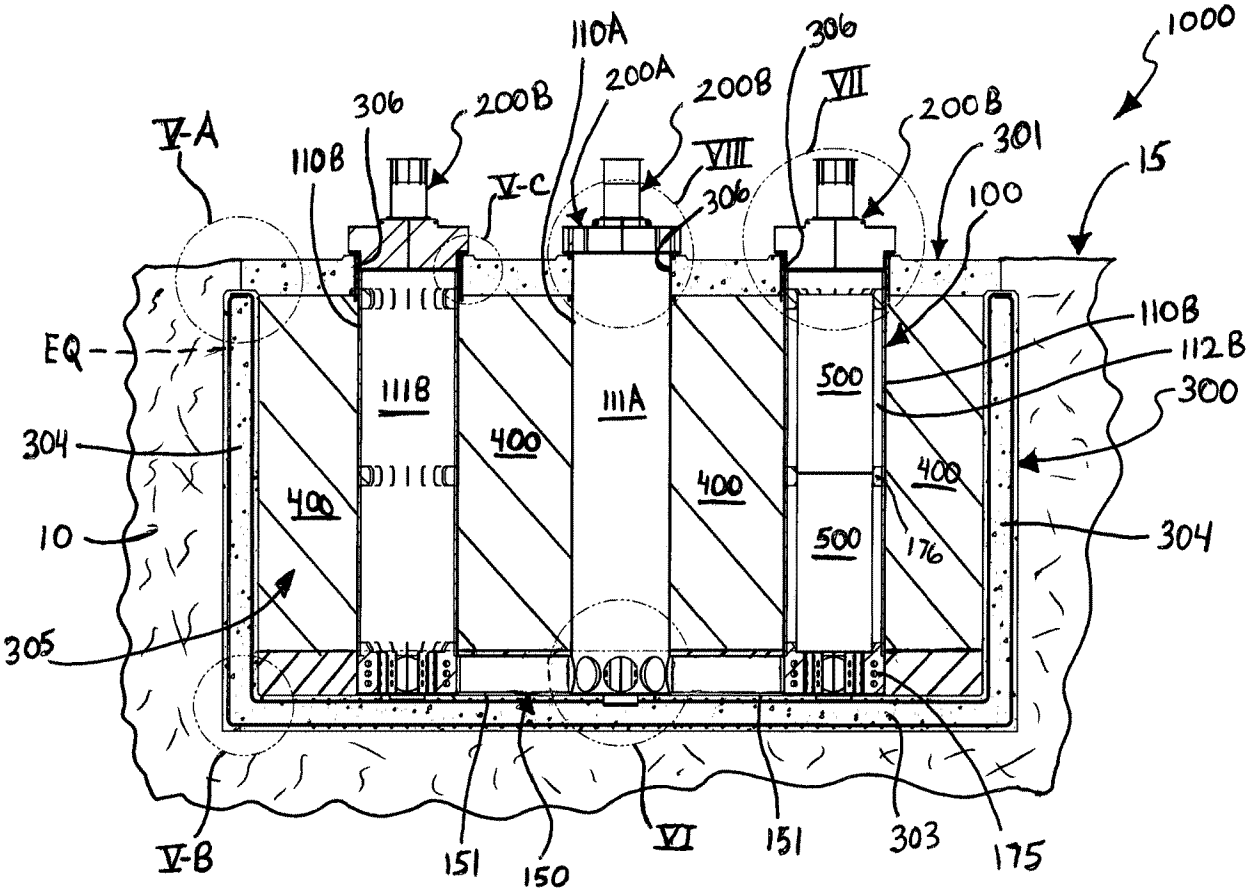
FIG. 3 is a cross-section taken along view of FIG. 4 of a ventilated system for storing high level radioactive waste according to an embodiment of the present invention, wherein the ventilated system is positioned below-grade.
Figure 4:
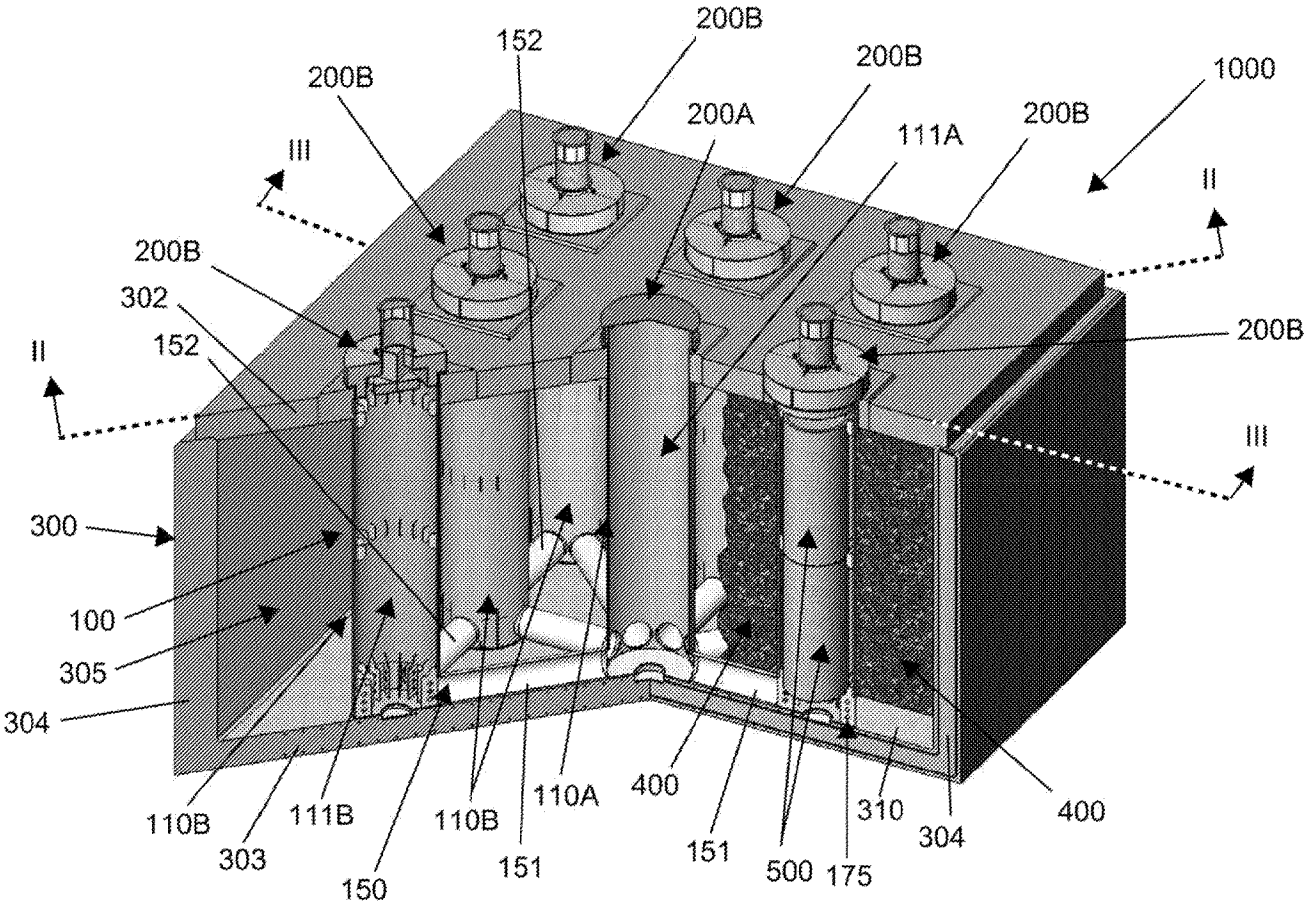
FIG. 4 is an isometric view a ventilated system for storing high level radioactive waste according to an embodiment of the present invention, wherein the ventilated system is removed from the ground and shown in partial cut-away.

Referring to FIG. 14 concurrently, a ventilated system 1000 for storing high level radioactive waste is illustrated according to one embodiment of the present invention. The ventilated system 1000 generally comprises a storage assembly 100, a plurality of removable lids 200A-3, an enclosure 300, radiation shielding fill 400 and hermetically sealed canisters 500. As illustrated in FIG. 4, the ventilated system 1000 is removed from the ground 10 (FIGS. 2-3). However, as shown in FIGS. 1-3, the ventilated system 1000 is specifically designed to achieve the dry storage of multiple hermetically sealed containers 500 containing high level radioactive waste in a below-grade environment (i.e., below the grade level 15 of the ground 10).

In the exemplified embodiment, the substantial entirety of the ventilated system 1000 (with the exception of the removable lids 200A-B) is below the grade level 15. More specifically, in the exemplified embodiment, a top surface 301 of a roof slab 302 of the enclosure 300 is substantially level with the surrounding grade-level 15. In other embodiments, a portion of the ventilated system 1000 may protrude above the grade level 15, in such instances, ventilated system 1000 is still considered to be "below-grade" so long as the entirety of the hermetically sealed canisters 500 supported, in the storage shells 110B are below the grade level 15. This takes full advantage of the radiation shielding effect of the surrounding soil/ground 10 at the ISFSI or ISF. Thus, the soil/ground 10 provides a degree of radiation shielding for high level radioactive waste stored in the ventilated system 100 that cannot be achieved in aboveground overpacks.

While the invention will be described herein as being used for the storage of spent/used nuclear fuel, the ventilated system 1000 can be used to store other types of high level radioactive waste. The term "hermetically sealed containers 500," as used herein is intended to include both canisters and thermally conductive casks that are hermetically sealed for the dry storage of high level wastes, such as spent nuclear fuel. Typically, such containers 500 comprise a honeycomb grid-work/basket, or other structure, built directly therein to accommodate a plurality of spent fuel rods in spaced relation. An example of a canister that is particularly suited for use in the present invention is a multi-purpose canister ("MPC"). An MPC that is particularly suitable for use in the present invention is disclosed in U.S. Pat. No. 5,898,747 to Krishna Singh, issued Apr. 27, 1999, the entirety of which is hereby incorporated by reference.

The ventilated system 1000 is a vertical, ventilated dry storage system that is folly compatible with 100 ton and 125 ton transfer casks for high level spent fuel canister transfer operations. The ventilated system 100 can be modified/designed to be compatible with any size or style transfer cask. The ventilated system 1000 is designed to accept multiple hermetically sealed containers 500 containing high level radioactive waste for storage at an ISFSI or ISF in lieu of above ground overpacks.

The ventilated system 1000 is a storage system that facilitates the passive cooling of the high level radioactive waste in the hermetically sealed containers 500 through natural convention/ventilation. The ventilated system 1000 is free of forced cooling equipment, such as blowers and closed-loop forced-fluid cooling systems. Instead the ventilated system 1000 utilizes the natural phenomena of rising warmed air, i.e., the chimney effect, to effectuate the necessary circulation of air about the hermetically sealed containers 500. In essence, the ventilated system 1000 comprises a plurality of modified ventilated vertical modules that can achieve the necessary ventilation/cooling of multiple containers 500 containing high level radioactive waste in a below grade environment.

The storage assembly 100 generally comprises a vertically oriented air-intake shell 110A, a plurality of vertically oriented storage shells 110B, and a network of pipes 150 for distributing air: (1) from the air-intake shell 110A to the storage shells 110B; and (2) between adjacent storage shells 110B. The storage shells 110B surround the air-intake shell 110A. In the exemplified embodiment, the air-intake shell 110A is structurally identical to the storage shells 110B. However, as will be discussed below, the air-intake shell 110A is intended to remain empty free of a heat load and unobstructed) so that it can act as an inlet downcomer passageway for cool air into the ventilated system 1000. Each of the storage shells 110B are adapted to receive two hermetically sealed containers 500 in a stacked arrangement and to act as storage/cooling chamber for the containers 500. However, in some embodiment of the invention, the air-intake shell 110A can be designed to be structurally different than the storage shells 110B so tong as the air-intake cavity 111A of the air-intake shell 110A allows the inlet of cool air for ventilating the storage shells 110B. Stated simply, the air-intake cavity 111A of the air-intake shell 110A acts as a downcomer passageway for the inlet of cooling an into the piping network 150 (discussed below).

The air-intake shell 110A, in other embodiments, has a cross-sectional shape, cross-sectional size, material of construction and/or height that is different than that of the storage shells 110B. While the air-intake shell 110A is intended to remain empty during normal operation and use, if the heat load of the containers 500 being stored in the storage shells 110B is sufficiently low such that circulating, air flow is not needed, the air-intake shell 110A can be used to one or more containers 500 (so long as an appropriate radiation shielding lid is positioned thereon).

In the exemplified embodiment, each the air-intake shell 110A and the plurality of storage shells 110B are cylindrical in shape. However, in other embodiments the shells 110A, 110B can take on other shapes, such as rectangular, etc. The shells 110A, 110B have an open top end and a closed bottom end. The shells 110A, 110B are arranged in a side-by-side orientation forming a 3×3 array. The air-intake shell 110A is located in the center of the 3×3 array. It should be noted that while it is preferable that the air-intake shell 110A be centrally located, the invention is not so limited. The location of the air-intake shell 110A in the array can be varied as desired. Moreover, while the illustrated embodiment of the ventilated system 1000 comprises a 3×3 array of the shells 110A, 110B, and other array sizes and/or arrangements can be implemented in alternative embodiments of the invention.

The shells 110A, 110B are preferably spaced apart in a side-by-side relation. The pitch between the shells 110A, 110B is in the range of about 15 to 25 feet, and more preferably about 18 feet. However, the exact distance between shells 110A, 110B will be determined on case by case basis and is not limiting of the present invention. The shells 110A, 110B are preferably constructed of a thick metal, such as steel, including low carbon steel. However, other materials can be used including, without limitation metals, alloys and plastics. Other examples include stainless steel, aluminum, aluminum-alloys, lead, and the like. The thickness of the shells 110A, 110B is preferably in the range of 0.5 to 4 inches, and most preferably about 1 inch. However, the exact thickness of the shells 110A, 110B will be determined on a case-by-case basis, considering such factors as the material of construction, the heat load of the spent fuel being stored, and the radiation level of the spent fuel being stored.

The air intake shell 110A forms an air-intake downcomer cavity 111A and extends along an axis A-A. In the exemplified embodiment, the axis A-A of the air-intake shell 110A is substantially vertically oriented. Each of the storage shells 110B forms a storage cavity 111B and extends along an axis B-B. In the exemplified embodiment, the axis B-B of each of the storage shells 110B is substantially vertically oriented. Each of the storage cavities 111B has a horizontal cross-section that accommodates no more than one of the containers 500 (which are loaded with high level radioactive waste). The horizontal cross-sections of the storage cavities 111B of the storage shells 110B are sized and shaped so that when the containers 500 are positioned therein for storage, a small gap/clearance 112B exists between the outer side walls of the containers 500 and the side walls of storage cavities Ill B. When the storage shells 110B and the containers 500 are cylindrical in shape, the gaps 112B are annular gaps.

Designing the storage cavities 111B of the storage shells 110B so that a small gap 112B is formed between the side walls of the stored containers 500 and the side walls of storage cavities 111B limits the degree the containers 500 can move within the storage cavities 111B during, a catastrophic event, thereby minimizing damage to the containers 500 and the storage shells 110B while prohibiting the containers 500 from tipping over within the storage cavities 111B. These small gaps 112B also facilitate flow of the heated air during cooling of the high level radioactive waste within the containers 500.

As mentioned above, the storage assembly 100 also comprises a network of pipes 150 that fluidly connect all of the storage shells 110B to the air-intake shell 110A (and to each other). The network of pipes 150 comprises a plurality of primary air-delivery pipes 151 and a plurality of secondary ah-delivery pipes 152. A primary air-delivery pipe 151 is provided for each of the storage shells 110B. For each storage shell 110B, the primary air-delivery pipe 151 that feeds that storage shell 110B forms a primary air-deliver passageway from a bottom of the air-intake downcomer cavity 111A to a bottom of the storage cavity 110B of that storage shell 110B. Thus, for each storage shell 110B, the entirety of the primary air-delivery passageway that delivers cool air to the storage cavity 111B of that storage shell 110B, is distinct from the entireties of all other of the primary air-deliver passageways of the storage assembly 100. For example, the primary air-delivery passageway of the primary air-delivery pipe 151 that delivers cool air to the storage cavity 111B of the top-left corner storage shell 110B extends along a first path, indicated by heavy arrowed line 155 in FIG. 1. However, the primary air-delivery passageway of the primary air-delivery pipe 151 that delivers cool air to the storage cavity 111B of the bottom-left corner storage shell 110B extends along a second path, indicated by heavy arrowed line 156 in FIG. 1. As can be seen, the first path 155 and second path 156 have no part in common. The same is true of all of the primary air-delivery passageways formed by the primary air-delivery pipes 151 of the storage assembly 100.

Each of the primary air-delivery pipes 151 extend along a substantially linear axis C-C that intersects the axis A-A of the air-intake shell 110A. The primary air-delivery pipes 151, in the exemplified embodiment, radiate from the axis A-A of the air-intake shell 110A along their axes C-C. In the exemplified embodiment, the substantially linear axis C-C of each of the primary air-delivery pipes 151 is substantially perpendicular to the axis A-A of the air-intake shell 110A. As can be seen, each of the primary air-delivery passageways formed by the primary air-delivery pipes 151 are located within the same horizontal plane near the bottom of the ventilated system 1000.

In the exemplified embodiment, there are eight (8) separate primary air-delivery passageways formed by the eight separate primary air-delivery pipes 151. In other embodiments, more or less than eight storage shells 110B cart be used and, thus, the appropriate number of primary air-delivery pipes 151 will also be sued. Moreover, in still other embodiments, the primary air-delivery pipes 151 may not be linear.

As mentioned above, the network of pipes 150 also comprises secondary air-delivery pipes 152 extending between each pair of adjacent ones of the storage shells 110B. Each secondary air-delivery pipe 152 forms a secondary air-delivery passageway between the bottoms of the storage cavities 111B of the adjacent ones of the storage shells 110B that it connects. As can be seen in FIG. 1, the secondary air-delivery passageways of the secondary air-delivery pipes 152 and the storage cavities 111B of the storage shells 110B collectively form a fluid-circuit loop 157 (which is a square loop in the exemplified embodiment). As can be seen, the entirety of the fluid-circuit loop 157 is independent of the entirety of all of the primary lair-delivery passageways formed by the primary air-delivery pipes 151 of the storage assembly 100.

Furthermore, as a result of the configuration of the pipes 151, 152 of the network of pipes 150 and the placement of the storage shells 110B and the air intake-shell 110A, there are at least three distinct air-delivery passageways leading from the air-intake cavity 111A to the storage cavity 111B of each storage cavity 110B. The entirety of each one of these three air-delivery passageways is distinct from the entireties of the other two of these air-delivery passageways. For example, for the storage cavity 111B of the top-right corner storage shell 110B of the array, there exists a first air-delivery path 157, a second air-delivery path 158 and a third air-delivery path 159 (all of which are delineated by the heavy dotted lines in FIG. 1). The first air-delivery path 157 passes through the primary air-delivery passageway of one of the primary air-delivery pipes 151, the storage cavity 111B of the upper-central storage shell 110B, and the secondary air-delivery passageway of one of the secondary air-delivery pipes 152. The second air-delivery path 158 passes only through the primary air-delivery passageway of another one of the primary air-delivery pipes 151. The third air-delivery path 159 passes through the primary air-delivery passageway of yet another one of the primary air-delivery pipes 151, the storage cavity 111B of the right-central storage shell 110B, and the secondary air-delivery passageway of another one of the secondary air-delivery pipes 152. As can be seen, the first air-delivery path 157, the second air-delivery path 158, and the third air-delivery path 159 have no part/portion in common. Therefore, every storage cavity 111A in the ventilated system 1000 is served by three distinct air-delivery paths that lead between that storage cavity 111A and the air-intake cavity 111A, ensuring double redundancy with respect to air supply to every container 500 loaded into the ventilated system 1000. In certain embodiments, the network of pipes 150 is configured so that the quantity of air drawn by each of the storage shells 110B adjusts to comply with Bernoulli's law. The air-flow through each storage cavity 111B (which is effectuated by the heat load of the container 500) is influenced by the air-flow drawn by any other of the storage cavities 111B in the ventilated system 1000. Additionally, as mentioned above, every storage cavity 111B in the system 1000 is fed with air by at least three distinct air-delivery passageways (i.e., paths) such that blockage in any two flow arteries will not cause a sharp temperature rise in the affected cells.

Due to the special configuration of the piping network 150, if one storage cavity 111B in the array was left empty, this empty storage cavity 111B would become another air intake downcomer passageway (similar to the one of the air intake shell 110). In other words, the air M the empty storage cavity 111B would flow downwards and begin feeding piping network 150 with cool air. In fact, any storage cavity 111B loaded with a low heat emitting canister can also become a downdraft cell. To determine which way the air will flow in an given canister loading situation, one will need to solve a set of non-linear (quadratic in flow) simultaneous equations (Bernoulli's equations for piping networks) with the aid of a computer program. A manual calculation in the manner of Torricelli's law may not be possible.

The advantages of the inter-connectivity of the piping network 150 becomes apparent when one considers the consequences of blocking a primary air-delivery pipe 151 leading to one storage cavity 111B (a compulsory safety question in nuclear plant design work) because that storage cavity 111B would not be deprived of the intake air as the neighboring/adjacent storage cavities 111B could provide relief to the distressed storage cavity 111B through two alternate and distinct pathways.

The network of pipes 150 hermetically and fluidly connect each of the air-intake cavity 111A and the storage cavities 111B together. All of the primary air-delivery pipes 151 and the secondary air-delivery pipes 152 hermetically connect at or near the bottom of the air-intake and storage shells 110A, 110B to form a network of fluid passageways between the cavities 111A, 111B. Of course, appropriately positioned openings are provided in the sidewalls of each of the air-intake shell 110A and the storage shells 110B to which the primary air-delivery pipes 151 and the secondary air-delivery pipes 152 of the piping network 150 are fluidly coupled. As a result, cool air entering the air-intake shell 110A can be distributed to all of the storage shells 110B via the piping network 150. It is preferable that the incoming cool air be supplied to at or near the bottom of the storage 111B of the storage shells 110B (via the openings) to achieve cooling of the containers 500 positioned therein. As best seen in FIG. 3, the hermetically sealed containers 500 are positioned within the storage cavities 111B such that no portion of the hermetically scaled containers 500 overlaps the openings in the sidewall of the storage shell 110B in which it is positioned. Stated another way, a bottom end of the hermetically sealed container 500 is located at an elevation above a top end of the openings in the sidewall of the storage shell 110B in which it is positioned. Thus, there is no line of sight through the openings in the storage shells 110B to the hermetically sealed container 500 positioned within that storage shell 110B.

Figure 6:
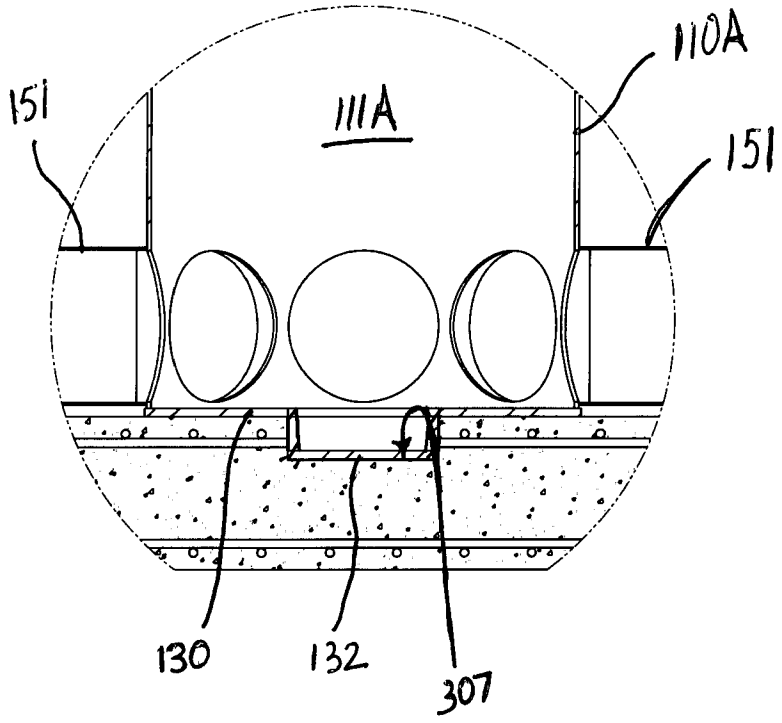
FIG. 6 is a close-up view of area VI of FIG. 3.
Figure 9:
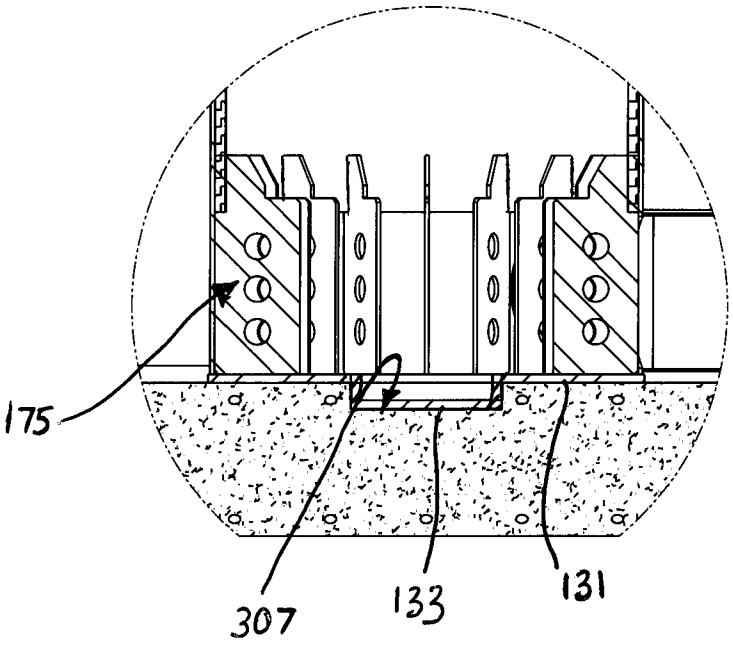
FIG. 9 is close-up view of area IX of FIG. 2.

The internal surfaces of the pipes 151, 152 of the piping network 150 and the shells 110, 10B are preferably smooth so as to minimize pressure loss. The primary and secondary air-delivery pipes 151, 152 are seal joined to each of the shells 110A, 110B to which they are attached to form an integral/unitary structure that is hermetically sealed to the ingress of water and other fluids. In the case of weldable metals, this seal joining may comprise welding or the use of gaskets. In the case of welding, the piping, network 150 and the shells 110A, 110B will form a unitary structure. Moreover, as shown in FIGS. 6 and 9, each of the shells 110A, 110B further comprise an integrally connected floor 130, 131. Thus, the only way water or other fluids can enter any of the internal cavities 111A, 111B of the shells 110A, 110B or the piping network 150 is through the top open end of the internal cavities, which is enclosed by the removable lids 200A, 200B.

An appropriate preservative, such as a coal tar epoxy or the like, is applied to the exposed surfaces of shells 110A, 110B and the piping network 150 to ensure sealing, to decrease decay of the materials, and to protect against fire. A suitable coal tar epoxy is produced by Carboline Company out of St. Louis, Mo. under the tradename Bitumastic 300M.

As mentioned above, the ventilated system 100 further comprises an enclosure 300. The enclosure 300 generally comprises a roof slab 302, a floor slab 303 and upstanding walls 304. The enclosure 300 forms an enclosure cavity 305 in which the storage assembly 100 is positioned. The enclosure cavity 305 is hermetically sealed so that below grade liquids cannot seep into or out of the enclosure cavity despite the roof slab 302 being at grade level 15.

The roof slab 303 comprises a plurality openings 306 that provide access to each of the air-intake cavity 111A and the storage cavities 111B. In the exemplified embodiment, each of the air-intake shell 110A and the storage shells 110B extend through the roof slab 302 of the enclosure 300 and, more specifically, through the openings 306. The interface between the air-intake shell 110A and the roof slab 302 and the interfaces between the storage shells 110B and the roof slab 302 are hermetic in nature. As a result, both the enclosure 300 and the shells 110A, 110B contribute the hermetic sealing of the enclosure cavity 305. Appropriate gaskets, sealants, O-rings, or tight tolerance components can be used to achieve the desired hermetic seals at these interfaces.

The roof slab 302 (which can also be thought of as an ISFSI pad) provides a qualified load, bearing surface for the cask transporter. The roof slab 302 also serves as the first line of defense against incident missiles and projectiles. The roof slab 302 is a monolithic reinforced concrete structure. The portion of the roof slab 302 adjacent to the openings 306 is slightly sloped and thicker than the rest to ensure that rain water will be directed away from the air-intake shell 110A and the storage shells 110B. The roof slab 302 serves several purposes in the ventilated system 1000, including: (1) providing an essentially impervious barrier of reinforced concrete against seepage of water from rain/snow into the subgrade; (2) providing the interface surface for flanges of the air-intake and storage shells 110A, 110B; (3) helps maintain a clean, debris-free region around each of the air-intake and storage shells 110A, 110B; and (4) provides the necessary riding surface for the cask transporter.

Figure 5C:
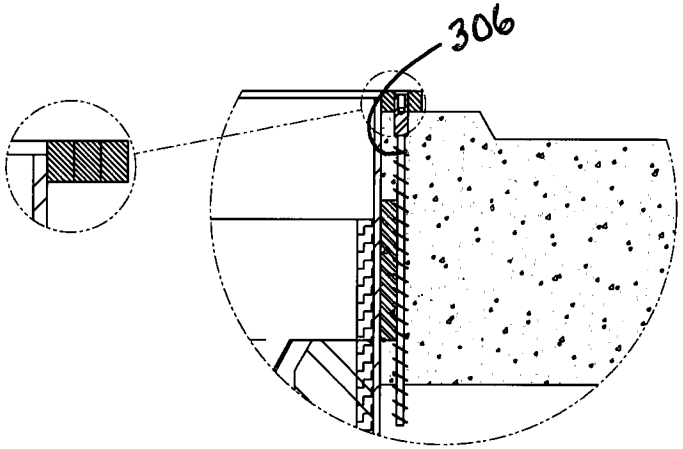
FIG. 5C is a close-up view of area V-C of FIG. 3.
Figure 5A:
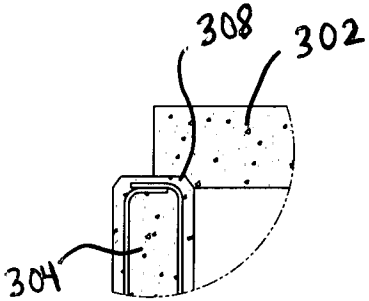
FIG. 5A is a close-up view of area V-A of FIG. 3.
Figure 5B:
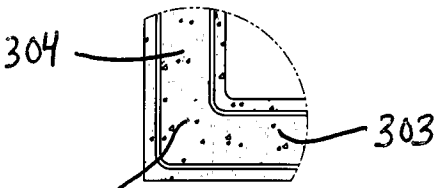
FIG. 5B is a close-up view of area V-B of FIG. 3.

The storage assembly 100 rests atop the floor slab 303, which is a reinforced concrete pad (also called a support foundation pad (SFP). Each of the shells 110A, 110B is keyed to the floor slab 303. In the exemplified embodiment, this keying is accomplished by aligning a protuberant portion 132, 133 of the floor 130, 131 with an appropriate recess 307 formed in the top surface of the floor slab 303 (see FIGS. 6 and 9). This keying also retrains lateral motion of each shell 110A, 11B with respect to the floor slab 303. The air-intake shell 110A sits in a slightly deeper recess in the floor slab 303 providing the "sump location" in the system 1000 for collection of dust, debris, groundwater, and the like, from where it is readily removed. The joints 308 (FIG. 5A) between the upstanding wall 304 and the roof slab 302 are engineered to prevent the ingress of water. Similarly, the joints 309 (FIG. 5B) between the upstanding wall 304 and the floor slab 303 are engineered to prevent the ingress of water. Of course, the either or both of the slabs 302, 303 can be integrally formed with the upstanding walls 304.

The floor slab 303 is sufficiently strong to support the weight of the loaded storage assembly 100 during long-term storage and earthquake conditions. As the weight of storage assembly 100, along with the weight of the loaded containers 500 is comparable to the weight of the subgrade excavated and removed, the additional pressure acting on the floor slab to produce long-term settlement is quite small.

In certain embodiments, once the storage assembly 100 is positioned atop the floor slab 303 as discussed above, the network of pipes 150 and the bottom portions of the shells 110A, 110B will be encased in a layer of grout 310. In certain embodiment, the layer of grout 310 may be omitted or replaced by a layer of concrete.

The remaining volume of the enclosure cavity 305 is filled with radiation shielding fill 400. In certain embodiment, the radiation shielding fill can be an engineered fill, soil, and/or a combination thereof. Suitable engineered fills include, without limitation, gravel, crushed rock, concrete, sand, and the like. The desired engineered fill can be supplied to the enclosure cavity 305 by any means feasible, including manually, dumping, and the like. In other embodiments, the remaining volume of the enclosure cavity 305 can be filled with concrete to form a monolithic structure with the enclosure 305.

In still other embodiments, the remaining volume of the enclosure cavity 305 can be filled with a low level radioactive material that provide radiation shielding to the high level radioactive waste within the containers 500. Suitable low level radioactive materials include low specific activity soil, low specific activity crushed concrete, low specific activity gravel, activated metal, low specific activity debris, and combinations thereof. The radiation from such low level radioactive waste is readily blocked by the steel and reinforced concrete structure of the enclosure 300. As a result, both the ground 10 (i.e., subgrade) and the low level radioactive waste/material serve as an effective shielding material against the radiation emanating from the high level waste stored in the containers 500. Sequestration of low specific activity waste in the subgrade space provides a valuable opportunity for plants that have such materials in copious quantities requiring remediation. Plants being decommissioned, especially stricken units such as Chernobyl and Fukushima, can obviously make excellent use of this ancillary benefit available in the subterranean canister storage system of the present invention.

Referring now to FIGS. 1-4 and 8 concurrently, an open top end of the air-intake cavity 110A is enclosed by a removable lid 200A. The removable lid 200A is detachably coupled either to the air-intake shell 110A or the roof slab 302 of the enclosure 300 as is known in the art. The removable lid 200A comprises one or more air-delivery passageway 221A that allow cool air to be drawn into the air-inlet cavity 111A. Appropriate screens can be provided over the one or more air-delivery passageway 221A. Because the air-intake cavity 111A is not used to store containers 500 containing high level radioactive waste, the removable lid 200A does not have to constructed of sufficient concrete and steel to provide radiation shielding, as do the removable lids 200B.

Referring now to FIGS. 1-4 and 7 concurrently, in order to provide the requisite radiation shielding for the loaded containers 500 stored in the storage cavities 111B, a removable lid 200B constructed of a combination of low carbon steel and concrete encloses each of the storage cavities 111B. The removable lids 200B are detachably coupled either to the storage shells 110B or the roof slab 302 of the enclosure 300 as is known in the art. The lid 200B comprises a flange portion 210B and a plug portion 211B. The plug portion 211B extends downward from the flange portion 210B. The flange portion 210B surrounds the plug portion 211B, extending therefrom in a radial direction.

One or more air-outlet passageways 221B are provided in each of the removable lids 200B. Each air-outlet passageways 221B forms a passageway from an opening 222B in the bottom surface 223B of the plug portion 211B to an opening 224B in an outer surface of the removable lid 200B. A cap 233B is provided over the opening 224B to prevent rain water or other debris from entering and/or blocking the air-outlet passageways 221B. The cap 233B is designed to prohibit rain water and other debris from entering into the opening 224B while affording heated air that enters the air-outlet passageways 221B to escape therefrom. In one embodiment, this can be achieved by providing a plurality of small holes not illustrated) in the wall 234B of the cap 233B just below the overhang of the roof of the cap 233B.

The air-outlet passageways 221B are curved so that a line of sight does not exist therethrough. This prohibits a line of sight from existing from the ambient environment to a container 500 that is loaded in the storage cavity 111B, thereby eliminating radiation shine into the environment. In other embodiments, the outlet vents may be angled or sufficiently tilted so that such a line of sight does not exist.

The removable lids 200A, 200B can be secured to the shells 110A, 110B or the enclosure 300) by bolts or other connection means. The removable lids 200A, 200B, in certain embodiments, are capable of being removed from the shells 110A, 110B without compromising the integrity of and/or otherwise damaging either the lids 200*a*, 200B, the shells 110A, 110B, or the enclosure 300. In other words, each removable lid 200A, 200B in some embodiments forms a non-unitary structure with its corresponding shell 101A, 110B and the enclosure 300. In certain embodiments, however, the lids 200A, 200B may be secured via welding or other semi-permanent connection techniques that are implemented once the storage shells 110B are loaded with a container 500 loaded with high level waste.

Figure 7:
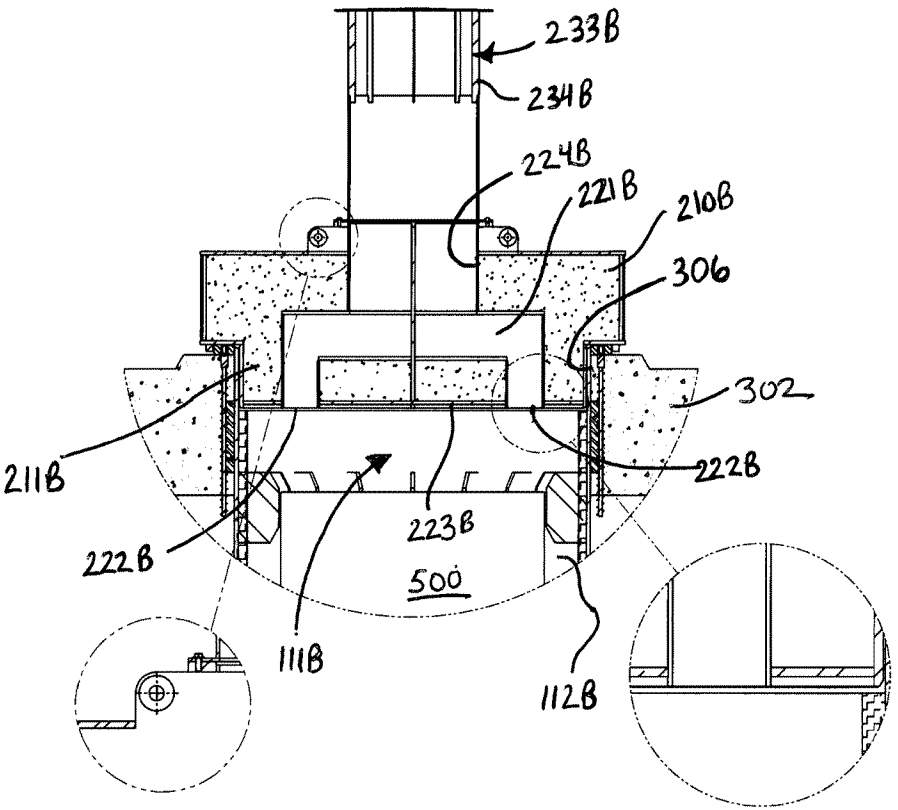
FIG. 7 is a close-up view of area VII of FIG. 3.
Figure 8:
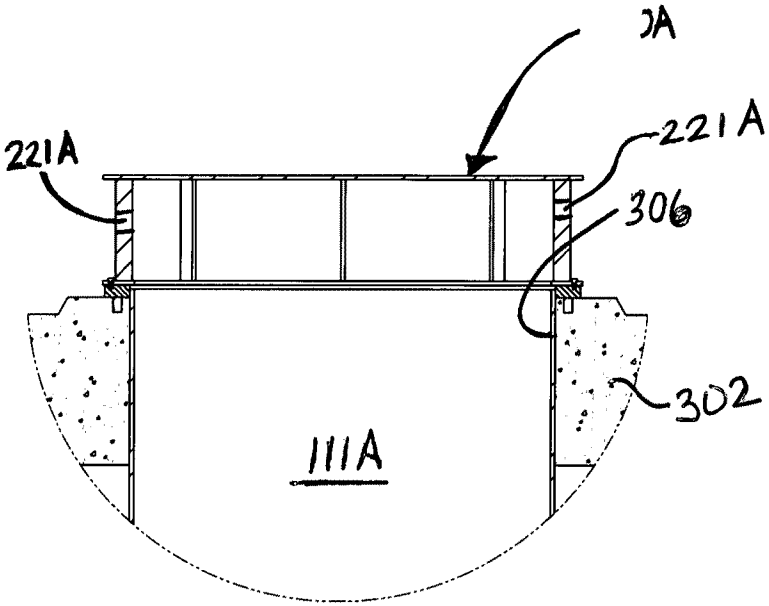
FIG. 8 is a close-up view of a top portion of an air-intake shell of the ventilated system of FIG. 4 with a removable lid enclosing a top end of the an cavity.

When the removable lids 200B are properly positioned atop the storage shells 110B as illustrated in FIG. 7, the air-outlet passageways 221B are in spatial cooperation with the storage cavities 111B. Each of the air-outlet passageways 221B form a passageway from the storage cavity 11B to the ambient atmosphere. The air-delivery passageway 221A of the removable lid 200A positioned atop the air-intake shell 110A provides a similar passageway.

With respect to the air-intake shell 110A, the air-delivery passageway 221A acts as a passageway that allows cool ambient air to be siphoned into the air-intake cavity 111A dale air-intake shell 110A, through the piping network 150, and into the bottom portion of the storage cavities 111B of the storage shells 110B. When containers 500 containing spent fuel or other high level waste having a heat load is positioned within the storage cavities 111B of one or more of the storage shells 110B, this incoming cool air is warmed by the containers 500, rises within the annular gaps 112B of the storage cavities 111B, and exits the storage cavities 111B via the air-outlet passageway 221B in the lids 200B atop the storage shells 110B. It is this chimney effect that creates the siphoning effect in the air-intake shell 110A.

Referring now to FIGS. 3, 4 and 9 concurrently, each of the storage shells 110A are made of sufficient height to hold a single container 500 or two containers 500 stacked on top of each other. In the stacked arrangement, the lower container 500 is supported on a support structure, which in the exemplified embodiment is set of radial lugs 175, that maintains the bottom end of the lower container 500 above the top of the primary air-delivery passageways formed by the primary air-delivery pipes 151. The radial lugs 175 are shaped to restrain lateral motion of the container 500 at the container's bottom end elevation. The top end of the lower container 500 is likewise laterally restrained by a set of radial guides 176. The radial guides 176 serve as an aid during insertion (or withdrawal) of the containers 500 and also provide the means to limit the rattling of the otherwise free-standing containers 500 during an earthquake by bearing against the "hard points" in the containers 500 (i.e., the containers' baseplates and top lids) and thus restricting their lateral movement to an engineered limit and protecting the stored high level waste against excessive inertia loads. The upper container 500 sits atop the bottom container 500 with or without a separator shim. Both extremities of the upper and lower containers 500 are laterally restrained by lugs 175 and/or guides 176 to inhibit rattling under seismic events. As can be seen, the entirety of the containers 500 are below the grade level 15 when supported in the storage cavities 111B.

Figure 10:
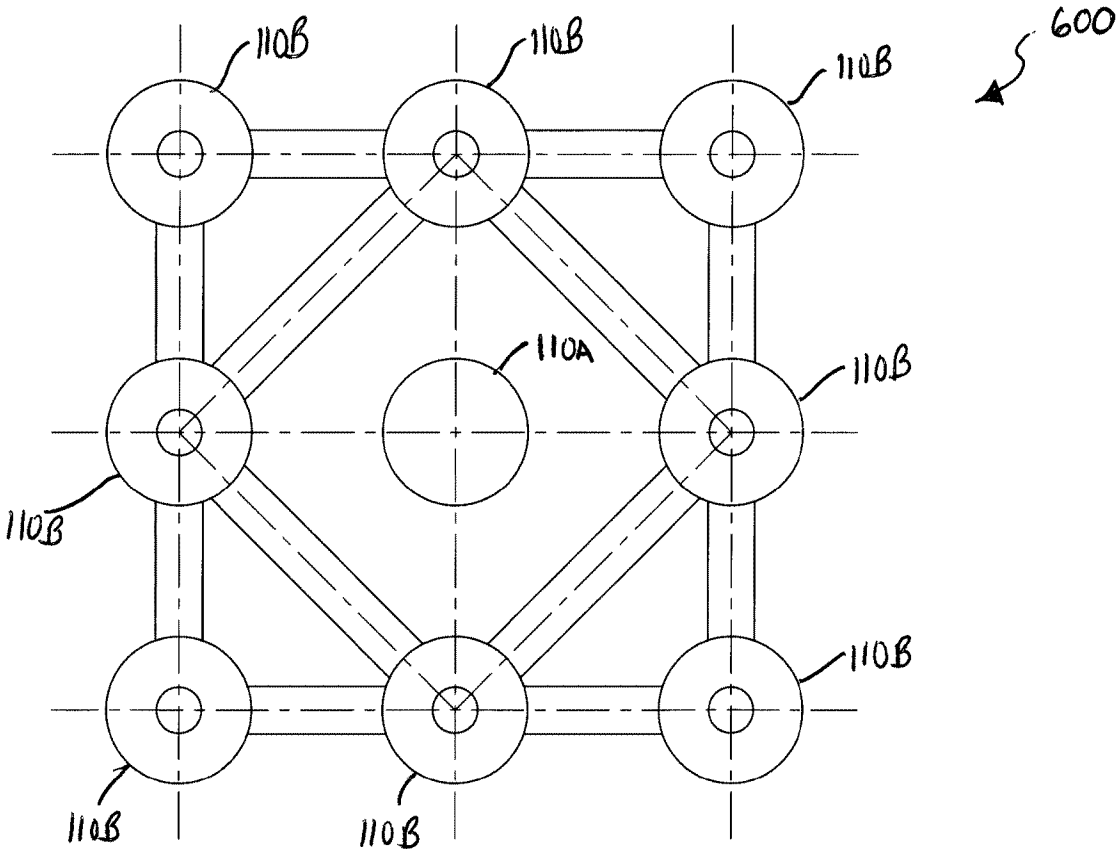
FIG. 10 is a schematic of an equalizer piping network that can be incorporated in other embodiments of the storage assembly for use in the ventilated system.

Referring to FIG. 10, in alternate embodiments of the ventilated, system 1000, the storage assembly 100 can be modified to include a network of equalizer pipes 600 to help augment the thermosiphon-driven air flow in those cases where the heat load in each storage cavity 111B is not equal (a nearly universal situation). The network of equalizer pipes 600 are a horizontal network located in the upper region of the storage cavities 111B, such as at the elevation delineated EQ in FIG. 3. The connection of network of equalizer pipes 600 to the storage shells 110B would be similar to that described above for the network of pipes 150. However, the network of equalizer pipes 600 are not coupled to the air-intake cavity 111A of the air-intake shell 110A.

Recognizing that high level waste such as SNF, is being housed in dry storage in a wide variety of containers at the different nuclear plant sites, the ventilated system 1000 is designed to accept them all. The ventilated system 1000 is a universal storage system that can interchangeably store any canister presently stored at any site in the U.S. This makes it possible for a single ventilated system 1000 of standardized design to serve all plants in its assigned region of the country. Further, it would be desirable for all regional storage sites in the country to have the same standardized design such that inter-site transfer of used fuel canisters is possible. Additionally, the number of canisters will increase in the future as the quantity of used fuel increases from ongoing reactor operations. The ventilated system 1000 is extensible to meet future needs by modularly reproducing the ventilated system 1000. The ventilated system 1000 takes up minimal land area so that if a centralized facility were to be built for all of the nation's fuel, it would not occupy an inordinate amount of space.

Referring again to FIGS. 1-4 generally, the ventilated, system 1000 is intended to be used in a vertical ventilated module construction. Thus, the ventilated system 1000 is directed to a subterranean vertical ventilated module assembly wherein the containers 500 are arrayed in parallel deep vertical storage cavities 111B. The ventilated system 1000 consists of a 3-by-3 array of shells 110A, 110B with the central air-intake cavity 111A serving as the air inlet plenum and the remaining eight storage cavities 111B storing up to two containers 500 each. The air-intake cavity 110A serves as the feeder for the ventilation air for all eight surrounding storage cavities 111B. The air-intake cavity 111A also contains the Telltale plates for prognosticating aging and corrosion effects on the other components of the storage assembly 100.

Additionally, the upper region of the air-intake shell 110A and the storage shells 110B are insulated in certain embodiment to prevent excessive heating of the incoming cool air and/or the radiation absorbing fill 400. The enclosure 300 is designed to be structurally competent to withstand the soil overburden and the Design Basis seismic loadings in the event that the subgrade adjacent to one of the upstanding walls 304 is being excavated for any reason (such as addition of another module array).

Each of the lids 200B are equipped with a radially symmetric opening and a short removable "flue" to serve as the exit path for the heated ventilation air rising in the annulus space 112B between the container 500 and the storage shell 110B. In certain embodiments, there is no storage cavity 111B inter-connectivity at any other elevation except at the very bottom region by the network of pipes 150.

In certain embodiments, the grade level may be defined as the riding surface on which the cask transporter rides rather than the surrounding native ground. The nine-cell storage assembly 100 is protected from intrusion of groundwater by the monolithic reinforced concrete enclosure 300. The second barrier against water ingress into the canister storage cavity is the shells 110A, 110B mentioned above. Finally, the hermetically sealed containers 500 serve as the third water exclusion barrier. The three barriers against water ingress built into the subterranean design are intended to ensure a highly reliable long-term environmental isolation of the high level waste.

It is recognized that the ventilated system 1000 can be arrayed next to each other in a compact configuration in the required number without limit at a site. However, each ventilated system 1000 retains its monolithic isolation system consisting of the enclosure 300, making it environmentally autonomous from others. Thus, as breach of isolation from the surrounding subgrade in one ventilated system 1000 (such as in-leakage of groundwater) if it were to occur, need not affect others. The affected module ventilated system 1000 can be readily cleared of all canisters and repaired. This long-term maintainability feature of the subterranean system is a key advantage to its users.

Another beneficial feature of the ventilated system 1000 is the ability to add a prophylactic cover to the outside of the subterranean surfaces of the enclosure 300 that are in contact with the earth, thus creating yet another barrier against, migration of materials between the enclosure cavity 305 and the earth around it.

In the embodiment shown, a single ventilated system 1000 will store 16 used fuel canisters containing up to 295,000 kilos of uranium from a typical 3400 MWt Westinghouse PWR reactor. Of course, the invention is not so limited and the system can store more or less than 16 fuel canisters as desired. As Table 1 below shows, the system occupies approximately 4,624 sq. feet of land area. As the subterranean ventilated system 1000 can be arrayed adjacent to each other without hunt, the land area required to store the entire design capacity of the Yucca Repository is merely 721,344 sq. feet or 16.5 acres.

TABLE 1

Typical Geometric and Construction Data for 16-Canister Subterranean Canister Storage System

| | |
|---|---|
| Length, feet | 68 |
| Width, feet | 68 |
| Depth, feet | 40 |
| Volume of Concrete Used, cubic feet | 52,000 |
| Volume of Grout Used, cubic feet | 10,800 |
| Volume of Subgrade Used, cubic feet | 98,000 |
| Quantity of steel used, U.S. tons | 330 |
| Land Area, square feet and (Acres) | 4,624 (0.106) |

Simulation of earthquake response of the subterranean ventilated system 1000 of the present invention under the strongest seismic motion recorded in the U.S. shows that the ventilated system 1000 will continue to store fuel safely in the earthquake's aftermath. This means that the exact same design can be used at all IFS sites around the country, making them completely fungible with each other.

Analysis of the impact of a crashing aircraft and other typical tornado-borne missiles showed that the subterranean canister storage system of the present invention will maintain the fuel in an unmolested state. Moreover, the single subterranean canister storage system of the present invention will reduce building costs.

Figure 11:
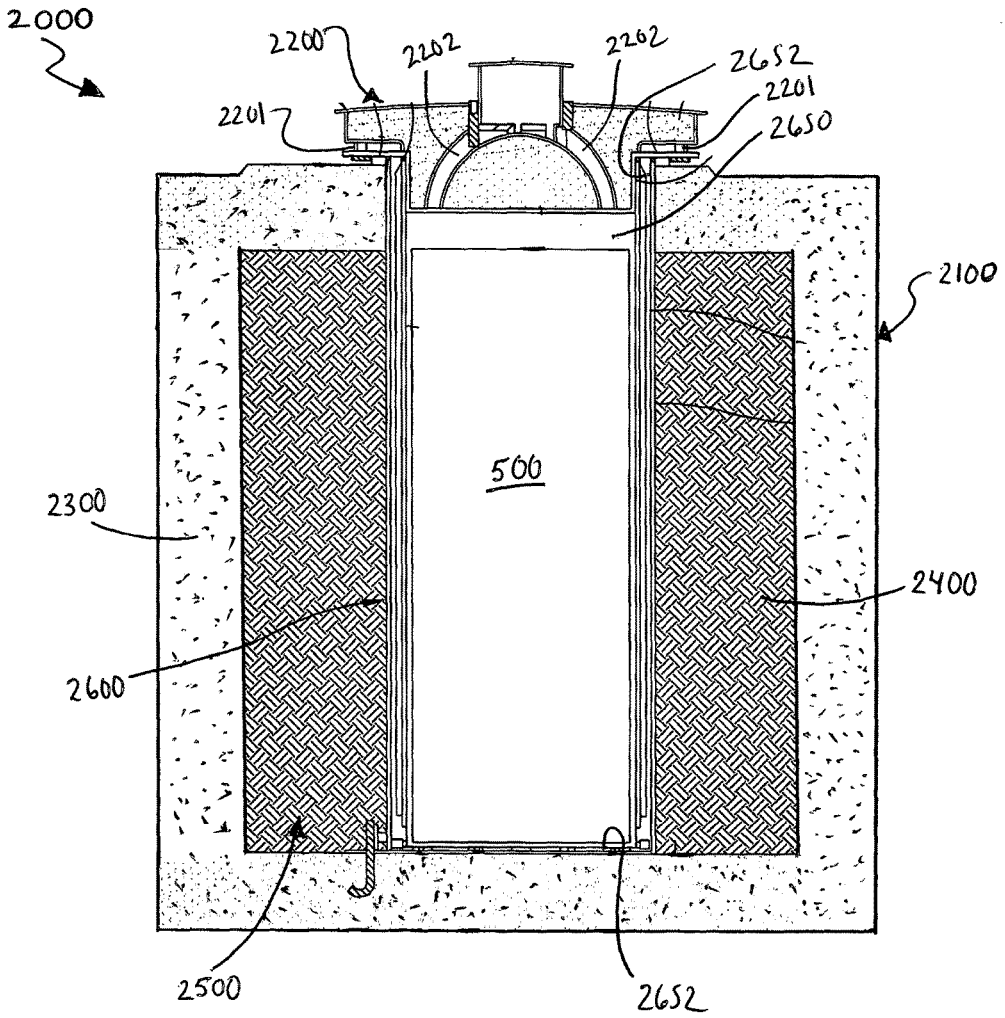
FIG. 11 is a cross-sectional view of a ventilated system according to another embodiment of the present invention in which low level radioactive waste is being used shield high level radioactive waste.

Referring now to FIG. 11, ventilated system 2000 according to a second embodiment of the present invention is illustrated. The ventilated system 2000 is structurally similar to the system disclosed in U.S. Pat. No. 7,330,526, issued Feb. 12, 2008 to Singh, the entirety of which is incorporated herein by reference for its structural details. However, unlike previous ventilated storage systems that are used to store containers 500 of high level waste, the ventilated system 2000 is modified so that a portion of the radiation shielding, provided by the body 2100 is provided by a mass of low level radioactive waste filler 2400. Similar to the ventilated system 1000, low level radioactive waste filler 2400 is hermetically sealed within an enclosure cavity 2500 formed by an enclosure 2300 and the storage shell 2600. The enclosure cavity 2500 is hermetically sealed as described above for ventilated system 1000.

Suitable low level radioactive materials include low specific activity soil, low specific activity crushed concrete, low specific activity gravel, activated metal, low specific activity debris, and combinations thereof. The radiation from such low level radioactive waste is readily blocked by the steel and reinforced concrete structure of the enclosure 2300. As a result, both the enclosure 2300 and the low level radioactive waste/material 2400 serve as an effective shielding material against the radiation emanating, from the high level waste stored in the container 500. Ventilations of the storage cavity 2650 is achieved as described in U.S. Pat. No. 7,330,526, the relevant portions of which are hereby incorporated by reference, and should be apparent from the illustration depicted in FIG. 11 of this application.

The radiation shielding body 2100 comprises the enclosure 2300 and the storage shell 2600. The radiation shielding, body 2100 forms the storage cavity 2650 in which the container 500 containing high level waste is positioned. The storage cavity 2650 has an open-top end 2651 and a closed-bottom end 2652. The open top end 2651 of the storage cavity is enclosed by the removable lid 220, which comprises both air-delivery passageways 2201 and air-outlet passageways 2202.

In certain embodiments, the ventilated system 2000 is positioned below grade so that the top surface 2001 of the enclosure 2300 is at or below a grade level. Moreover, it should be noted that the idea of including a mass of low level, radioactive waste/material within a sealed space of an enclosure to provide radiation shielding for high level radioactive waste can be implemented in a wide variety of cask, overpack and storage facility arrangements.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A ventilated system for storing high level radioactive waste comprising:

a below-grade storage assembly comprising:

an air-intake shell forming an air-intake downcomer cavity and extending along a central axis;

a plurality of storage shells surrounding the air-intake shell in a side-by-side relationship, each storage shell forming a storage cavity and extending along a central axis, each of the storage shells comprising a sidewall having a first opening, a second opening, and a third opening each of which provides a passageway into a bottom of the storage cavity;

for each storage shell:

a primary air-delivery pipe extending from the air-intake shell to the first opening in the sidewall, the primary air-delivery pipe forming a primary air-delivery passageway that extends along a substantially linear axis from a bottom of the air-intake downcomer cavity to the bottom of the respective storage cavity, wherein the entirety of each of the primary air-delivery passageways is distinct from the entireties of all other of the primary air-delivery passageways of the below-grade storage assembly, and wherein the substantially linear axis of the primary air-delivery pipe intersects the central axis of the air-intake shell; and a first secondary air-delivery pipe extending from the second opening in the sidewall of the storage shell to one of the openings in the sidewall of a first adjacent one of the storage shells and a second secondary air-delivery pipe extending from the third opening in the sidewall of the storage shell to one of the openings in the sidewall of a second adjacent one of the storage shells, each of the first and second secondary air-delivery pipes forming a secondary air-delivery passageway that extends along a substantially linear axis between the bottom of the storage cavity of the storage shell and the bottom of the storage cavity of one of the first and second adjacent storage shells;

a hermetically sealed container for holding high level radioactive waste positioned in one or more of the storage cavities;

a lid positioned atop each of the storage shells and comprising at least one air-outlet passageway; and wherein for each storage cavity in which one of the hermetically sealed containers is positioned, a bottom end of the hermetically sealed container is located at an elevation above an uppermost end of the primary air-delivery passageway for that storage cavity.

2. The ventilated system according to claim 1 wherein the substantially linear axis of each of the primary air-delivery pipes is substantially perpendicular to the central axis of the air-intake shell.

3. The ventilated system according to claim 1 wherein the central axis of the air-intake shell and the central axis of each of the storage shells are substantially vertical, and wherein each of the primary air-delivery passageways are located within the same horizontal plane.

4. The ventilated system according to claim 1 wherein the secondary air-delivery passageways and the storage cavities of the plurality of storage shells collectively form a fluid-circuit loop, wherein the entirety of the fluid-circuit loop is independent of the entirety of all of the primary air-delivery passageways of the below-grade storage assembly.

5. The ventilated system according to claim 1 wherein for each storage cavity, there are at least three air-delivery passageways leading from the air-intake cavity to the storage cavity, wherein the entirety of each of the three air-delivery passageways is distinct from the entireties of the other two air-delivery passageways.

6. The ventilated system according to claim 1 wherein the below-grade storage assembly is hermetically sealed to the ingress of below-grade fluids.

7. The ventilated system according to claim 1 wherein at least two of the hermetically sealed containers are positioned in each of the storage cavities in a stacked arrangement.

8. The ventilated system according to claim 1 wherein each of the storage cavities has a transverse cross-section that accommodates no more than one of the containers.

9. The ventilated system according to claim 1 further comprising an enclosure forming an enclosure cavity, the below-grade storage assembly positioned within the enclosure cavity such that the air-intake shell and the storage shells extend though a roof slab of the enclosure, wherein the enclosure comprises a floor slab, the below-grade storage assembly positioned atop and secured to the floor slab, and the ventilated system further comprising a layer of grout in the enclosure that encases a bottom portion of the air-intake cavity, bottom portions of the storage cavities, and all air-delivery pipes; wherein a remaining volume of the enclosure cavity is filled with low level radioactive waste that provides radiation shielding for the high level radioactive waste within the hermetically sealed containers; and wherein the low level radioactive waste is selected from a group consisting of low specific activity soil, low specific activity crushed concrete, low specific activity gravel, activated metal, and low specific activity debris.

10. The ventilated system according to claim 1 wherein the hermetically sealed containers are positioned within the storage cavities such that no portion of the hermetically sealed container overlaps the openings in the sidewall of the storage shell in which it is positioned.

11. The ventilated system according to claim 10 wherein the bottom end of the hermetically sealed container is located at an elevation above a top end of the openings in the sidewall of the storage shell in which it is positioned.

12. The ventilated system according to claim 10 wherein there is no line of sight through the openings in the storage shells to the hermetically sealed container positioned within that storage shell.

13. A ventilated system for storing high level radioactive waste comprising:

a below-grade storage assembly comprising:

an air-intake shell forming an air-intake downcomer cavity and extending along a central axis;

a plurality of storage shells surrounding the air-intake shell in a side-by side relationship, each storage shell forming a storage cavity and extending along a central axis, for each storage shell:

a primary air-delivery pipe that forms a primary air-delivery passageway that extends from a bottom of the air-intake downcomer cavity to a bottom of the respective storage cavity, wherein the entirety of each of the primary air-delivery passageways is distinct from the entireties of all other of the primary air-delivery passageways of the below-grade storage assembly; and a secondary air-delivery pipe extending between each pair of adjacent ones of the storage shells, the secondary air-delivery pipe forming a secondary air-delivery passageway between the bottoms of the storage cavities of the adjacent ones of the storage shells;

a hermetically sealed container for holding high level radioactive waste positioned in one or more of the storage cavities; and a lid positioned atop each of the storage shells and comprising at least one air-outlet passageway.

14. The ventilated system according to claim 13 wherein the secondary air-delivery passageways and the storage cavities of the plurality of storage shells collectively form a fluid-circuit loop, wherein the entirety of the fluid-circuit loop is independent of the entirety of all of the primary air-delivery passageways of the below-grade storage assembly.

15. The ventilated system according to claim 13 wherein for each storage cavity in which one of the hermetically sealed containers is positioned, a bottom end of the hermetically sealed container is located at an elevation above an uppermost end of the primary air-delivery passageway for that storage cavity.

16. The ventilated system according to claim 15 wherein each storage shell has a sidewall with an opening therein at which the primary air-delivery pipe for that storage shell terminates, and wherein the hermetically sealed containers are positioned within the storage cavities such that no portion of the hermetically sealed container overlaps the opening in the sidewall of the storage shell in which it is positioned.

17. The ventilated system according to claim 16 wherein the bottom end of the hermetically sealed container is located at an elevation above a top end of the opening in the sidewall of the storage shell in which it is positioned.

18. The ventilated system according to claim 16 wherein there is no line of sight through the opening in the storage shells to the hermetically sealed container positioned within that storage shell.

19. A ventilated system for storing high level radioactive waste comprising:

a below-grade storage assembly comprising a plurality of shells arranged in a side-by-side orientation forming a 3×3 array, the plurality of shells comprising:

an air-intake shell located in a center of the 3×3 array and forming an air-intake downcomer cavity, the air-intake shell extending along a central axis and comprising a sidewall having eight openings therein, each of the openings forming a passageway into a bottom portion of the air-intake downcomer cavity;

eight storage shells collectively surrounding the air-intake shell in a spaced apart manner such that each storage shell is adjacent to two other storage shells, each storage shell forming a storage cavity and comprising a sidewall having a first opening, a second opening, and a third opening, each of the first, second, and third openings forming a passageway into a bottom portion of the storage cavity of the storage shell;

a plurality of primary air-delivery pipes extending between the air-intake shell and the storage shells such that one of the primary air-delivery pipes extends from each of the openings in the sidewall of the air-intake shell to the first opening in the sidewall of one of the eight storage shells, each of the primary air-delivery pipes forming a distinct primary air-delivery passageway that extends along a linear axis from the bottom portion of the air-intake downcomer cavity to the bottom portion of the respective storage cavity;

for each of the storage shells:

a first secondary air-delivery pipe extending from the second opening in the sidewall of the storage shell to one of the openings in the sidewall of a first adjacent one of the storage shells; and a second secondary air-delivery pipe extending from the third opening in the sidewall of the storage shell to one of the openings in the sidewall of a second adjacent one of the storage shells, each of the first and second secondary air-delivery pipes forming a secondary air-delivery passageway that extends along a substantially linear axis between the bottom portion of the storage cavity of the storage shell and the bottom portion of the storage cavity of one of the first and second adjacent storage shells;

a hermetically sealed container for holding high level radioactive waste positioned in one or more of the storage cavities;

a lid positioned atop each of the storage shells and comprising at least one air-outlet passageway; and wherein the primary air-delivery pipes and the first and second secondary air-delivery pipes form three distinct air-delivery passageways from the air-intake downcomer cavity to the storage cavity of each of the storage shells.

20. The ventilated system according to claim 19 wherein for each of the storage shells, the three distinct air-delivery passageways comprises:

a first air-delivery passageway extending from the air-intake downcomer cavity to the storage cavity directly, the first air-delivery passageway comprising a first one of the primary air-delivery passageways extending from the air-intake shell to the first opening in the storage shell;

a second air-delivery passageway extending from the air-intake downcomer cavity to the storage cavity, the second air-delivery passageway comprising: a second one of the primary air-delivery passageways extending from the air-intake shell to the first adjacent one of the storage shells, the storage cavity of the first adjacent one of the storage shells, and the first secondary air-delivery pipe extending from the first adjacent one of the storage shells to the second opening in the sidewall of the storage shell; and a third air-delivery passageway extending form the air-intake downcomer cavity to the storage cavity, the third air-delivery passageway comprising: a third one of the primary air-delivery passageways extending from the air-intake shell to the second adjacent one of the storage shells, the storage cavity of the second adjacent one of the storage cavities, and the second secondary air-delivery pipe extending from the second adjacent one of the storage shells to the third opening in the sidewall of the storage shell.

* * * * *